US010036550B1

(12) United States Patent
Reid

(10) Patent No.: US 10,036,550 B1
(45) Date of Patent: Jul. 31, 2018

(54) TRAFFIC CROSS-GUARD REFLECTIVE MAT

(71) Applicant: Derrick Reid, Randolph, MA (US)

(72) Inventor: Derrick Reid, Randolph, MA (US)

( * ) Notice: Subject to any disclaimer, the term of this patent is extended or adjusted under 35 U.S.C. 154(b) by 29 days.

(21) Appl. No.: 15/201,826

(22) Filed: Jul. 5, 2016

(51) Int. Cl.

| | |
|---|---|
| ***F21V 9/16*** | (2006.01) |
| ***F21V 33/00*** | (2006.01) |
| ***F21V 7/00*** | (2006.01) |
| ***F21V 17/10*** | (2006.01) |
| ***F21L 4/02*** | (2006.01) |
| ***F21V 9/30*** | (2018.01) |
| *F21Y 115/10* | (2016.01) |
| *F21Y 105/16* | (2016.01) |

(52) U.S. Cl.
CPC ..... *F21V 33/0076* (2013.01); *F21L 4/02* (2013.01); *F21V 7/0025* (2013.01); *F21V 9/16* (2013.01); *F21V 9/30* (2018.02); *F21V 17/107* (2013.01); *F21Y 2105/16* (2016.08); *F21Y 2115/10* (2016.08)

(58) Field of Classification Search
CPC ..... F21V 33/0076; F21V 17/107; F21L 4/02; F21Y 2115/10
USPC ..... 362/84, 127, 134, 389
See application file for complete search history.

(56) References Cited

U.S. PATENT DOCUMENTS 4,454,188 A 6/1984 Penta
4,697,294 A * 10/1987 Schafer ..... E01O 5/005 14/69.5
5,267,367 A * 12/1993 Wegmann, Jr. ..... A62C 33/06 14/69.5
5,419,065 A * 5/1995 Lin ..... B60Q 7/00 40/550
5,848,830 A * 12/1998 Castle ..... A47G 27/0243 362/253
6,045,294 A 4/2000 Hansen
6,389,720 B1 * 5/2002 Hsieh ..... B60Q 7/00 116/63 T
6,413,010 B2 7/2002 Coleman
7,670,022 B2 * 3/2010 Kessler ..... A47L 23/266 362/153
7,670,026 B1 * 3/2010 Hawkins ..... A47G 27/0212 362/153
D650,529 S 12/2011 Blackford
8,206,002 B1 * 6/2012 Olson ..... B25H 5/00 280/32.6
8,288,652 B2 * 10/2012 Lubanski ..... H02G 9/025 104/275
8,444,294 B1 * 5/2013 Hawkins ..... A47G 27/0212 362/100
8,791,363 B2 * 7/2014 Lubanski ..... H02G 9/025 104/275
8,859,073 B1 * 10/2014 Callas ..... B32B 3/02 343/720
9,068,720 B2 * 6/2015 Mangus ..... F21V 15/01
(Continued)

FOREIGN PATENT DOCUMENTS

EP 1308120 A2 8/2008

*Primary Examiner* — Paultep Savusdiphol

(57) ABSTRACT

The traffic cross-guard reflective mat is adapted for use by traffic officers. The traffic cross-guard reflective mat is a highly visible reflective mat that is designed to attract attention from a distance. The traffic officer stands on the traffic cross-guard reflective mat in order to benefit from the attention drawn by the traffic cross-guard reflective mat. The traffic guard reflective mat comprises a mat, a plurality of reflective surfaces and a plurality of lights.

3 Claims, 5 Drawing Sheets

(56) References Cited

U.S. PATENT DOCUMENTS

| | | | | |
|---|---|---|---|---|
| 9,212,814 | B2 * | 12/2015 | Puljan | F21V 33/004 |
| 9,475,426 | B1 * | 10/2016 | Bobo | B60N 3/042 |
| 2003/0231485 | A1 * | 12/2003 | Chien | A41D 27/085 362/84 |
| 2005/0025569 | A1 * | 2/2005 | Kozlowski | E01F 9/529 404/15 |
| 2005/0270179 | A1 * | 12/2005 | Sherman | G08G 1/164 340/933 |
| 2005/0278998 | A1 * | 12/2005 | Sawhney | G09F 9/33 40/541 |
| 2006/0017658 | A1 * | 1/2006 | Biondo | G09F 9/33 345/30 |
| 2007/0044357 | A1 * | 3/2007 | Biondo | G09F 9/33 40/544 |
| 2007/0247834 | A1 | 10/2007 | Turner | |
| 2009/0126139 | A1 * | 5/2009 | Batti | A47G 27/0243 15/216 |
| 2009/0194328 | A1 * | 8/2009 | Lubanski | H02G 9/025 174/72 R |
| 2012/0069552 | A1 | 3/2012 | Richter | |
| 2014/0375434 | A1 * | 12/2014 | Puljan | F21V 33/004 340/12.5 |
| 2015/0073623 | A1 * | 3/2015 | Zhang | G09F 13/16 701/2 |
| 2015/0376849 | A1 * | 12/2015 | Thompson | E01F 9/604 404/15 |
| 2016/0037610 | A1 * | 2/2016 | Kiser | H05B 37/0227 315/360 |
| 2016/0166876 | A1 * | 6/2016 | Goh | A63B 24/0062 482/9 |
| 2017/0108201 | A1 * | 4/2017 | Shields | F21V 21/145 |

* cited by examiner

TRAFFIC CROSS-GUARD REFLECTIVE MAT

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of safety arrangements for slowing and redirecting vehicles, more specifically, a reflective mat adapted for use by traffic control officers.

SUMMARY OF INVENTION

The traffic cross-guard reflective mat is adapted for use by traffic officers. The traffic cross-guard reflective mat is a highly visible reflective mat that is designed to attract attention from a distance. The traffic officer stands on the traffic cross-guard reflective mat in order to benefit from the attention drawn by the traffic cross-guard reflective mat.

These together with additional objects, features and advantages of the traffic cross-guard reflective mat will be readily apparent to those of ordinary skill in the art upon reading the following detailed description of the presently preferred, but nonetheless illustrative, embodiments when taken in conjunction with the accompanying drawings.

In this respect, before explaining the current embodiments of the traffic cross-guard reflective mat in detail, it is to be understood that the traffic cross-guard reflective mat is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the traffic cross-guard reflective mat.

It is therefore important that the claims be regarded as including such equivalent construction insofar as they do not depart from the spirit and scope of the traffic cross-guard reflective mat. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
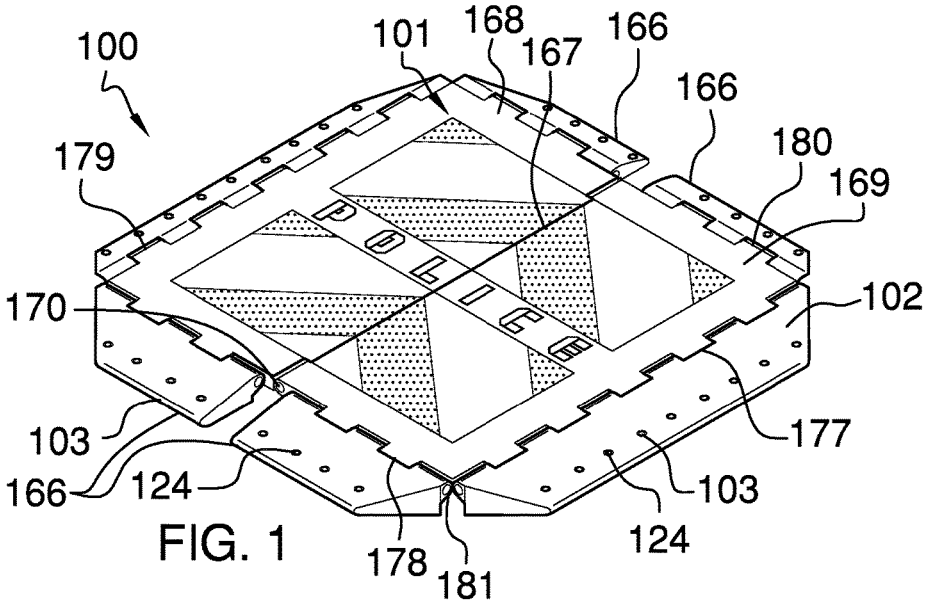
FIG. 1 is a perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 7.

The cross-traffic guard reflective mat 100 (hereinafter invention) comprises a mat 101, a plurality of reflective surfaces 102 and a plurality of lights 103. The invention 100 is adapted for use by traffic officers 131. The invention 100 is a highly visible reflective mat 101 that is designed to attract attention from a distance. The traffic officer 131 stands on the invention 100 in order to benefit from the attention drawn by the invention 100.

The mat 101 is a solid structure that is formed in the shape of a truncated right pyramid. The mat 101 is formed from a structural plastic and is sized such that the mat 101 will raise a traffic officer 131 off the ground. The surface of the mat 101 that is placed in contact with the resting surface 132 is formed with a plurality of non-skid ridges 111 that prevent the mat 101 from skidding when the mat 101 is in use.

The plurality of reflective surfaces 102 comprises the surfaces of the mat 101 that are visible when the mat 101 is placed in the position intended for usage. Each of the plurality of reflective surfaces 102 further comprises a fluorescent material, such as a fluorescent pigment, that absorbs the ambient radiation, including light, and emits a readily visible and noticeable radiation that the draws attention of drivers both to the mat 101 and the traffic officer 131.

The plurality of reflective surfaces 102 are each hingedly attached to the mat 101. The plurality of reflective surfaces 102 is hingedly attached to a first edge 177, a second edge 178, a third edge 179, and a fourth edge 180 of the mat. The first edge 177, the second edge 178, the third edge 179, and the fourth edge 180 form a perimeter of the mat 101. Each of the plurality of reflective surfaces 102 attach via a hinge pin 181 to the first edge 177, the second edge 178, the third edge 179, and the fourth edge 180. The hinge pin 181 enables each of the plurality of reflective surfaces 102 to rotate relative a respective edge of the perimeter of the mat 101 in order to reduce overalls surface area when not in use, and for storage purposes (see FIG. 3).

Figure 2:
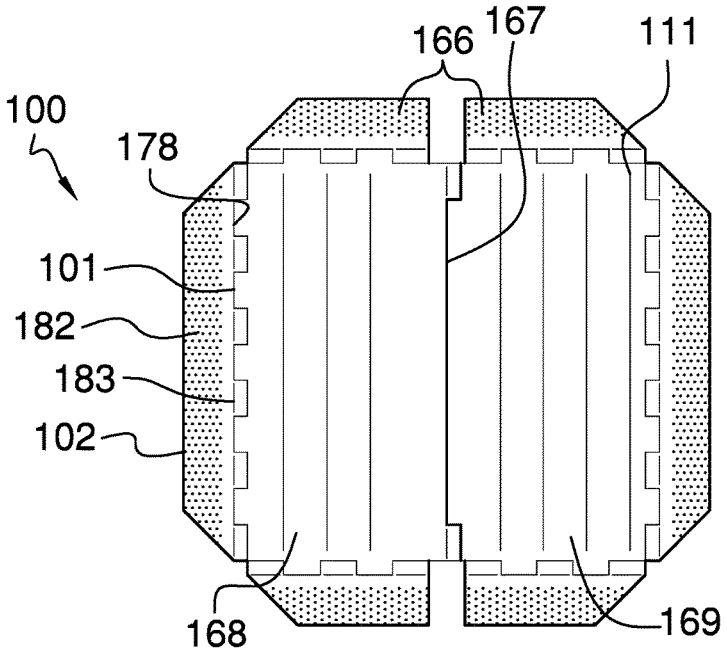
FIG. 2 is a bottom view of an embodiment of the disclosure.
Figure 3:
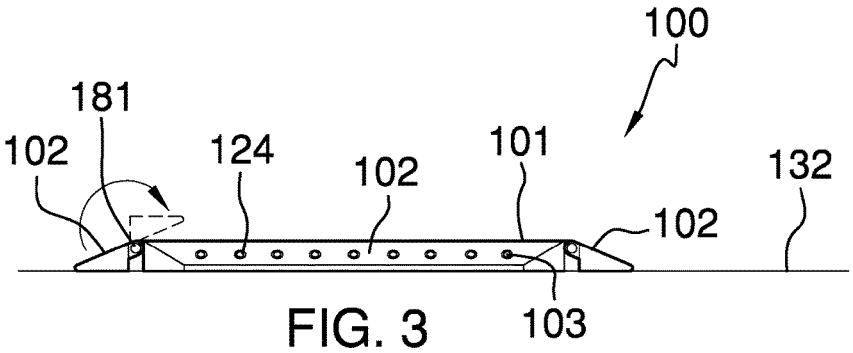
FIG. 3 is a side view of an embodiment of the disclosure.
Figure 4:
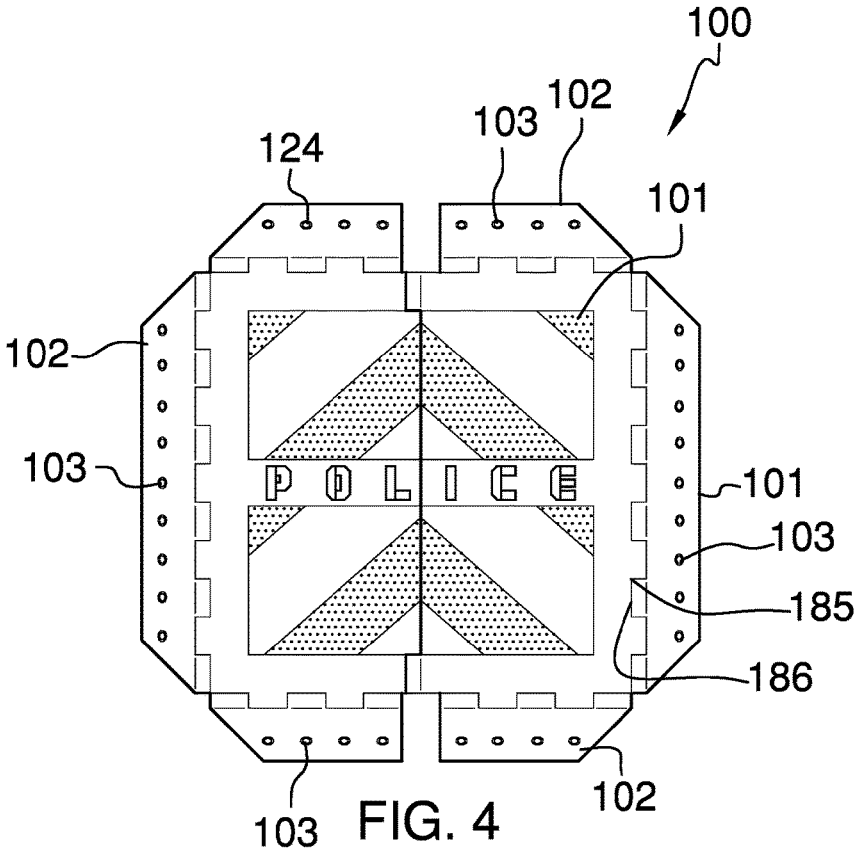
FIG. 4 is a top view of an embodiment of the disclosure.
Figure 5:
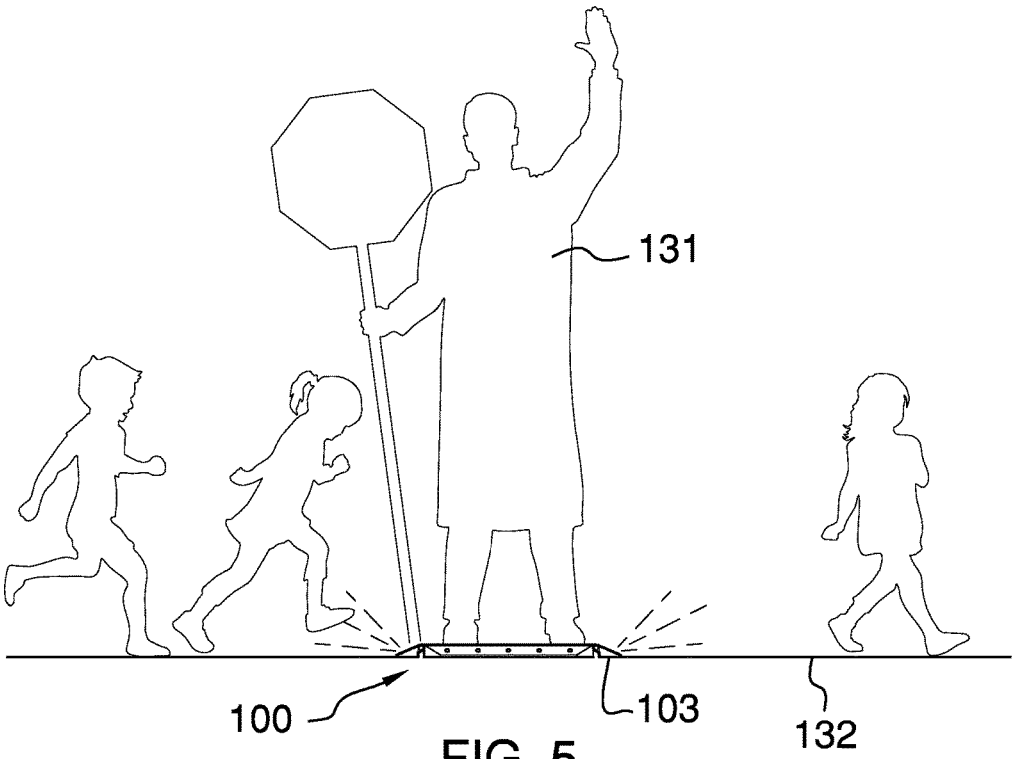
FIG. 5 is an in use view of an embodiment of the disclosure.

Referring to FIG. 3, the plurality of reflective surfaces 102 has an angled cross-section, which tapers down from the mat 101 to the supporting surface 132. Referring to FIG. 2, the plurality of reflective surfaces 102 each has a non-skid element 182 on a bottom surface 183, which works in concert with the non-skid ridges 111 of the mat 101 to abate or inhibit movement of the invention 100 with respect to the supporting surface 132.

Each of the plurality of reflective surfaces 102 has a trapezoidal shape when viewed from above. In assembly, the invention 100 forms an octagonal shape. The first edge 177, the second edge 178, the third edge 179, and the fourth edge 180 of the mat 101 each have a plurality of recessed edges 185 that correspond with notches 186 provided on the plurality of reflective surfaces 102. The hinge pin 181 traverses between the notches 186 and the recessed edges 185 to provide pivoting movement between the mat 101 and the plurality of reflective surfaces 102.

Figure 6:
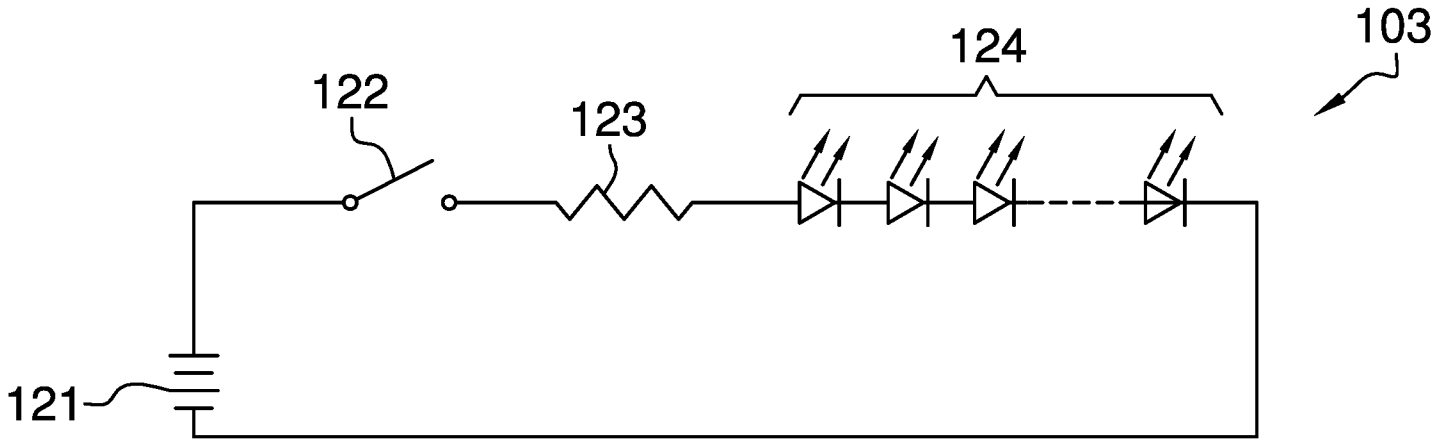
FIG. 6 is an electrical schematic of an embodiment of the disclosure.
Figure 7:
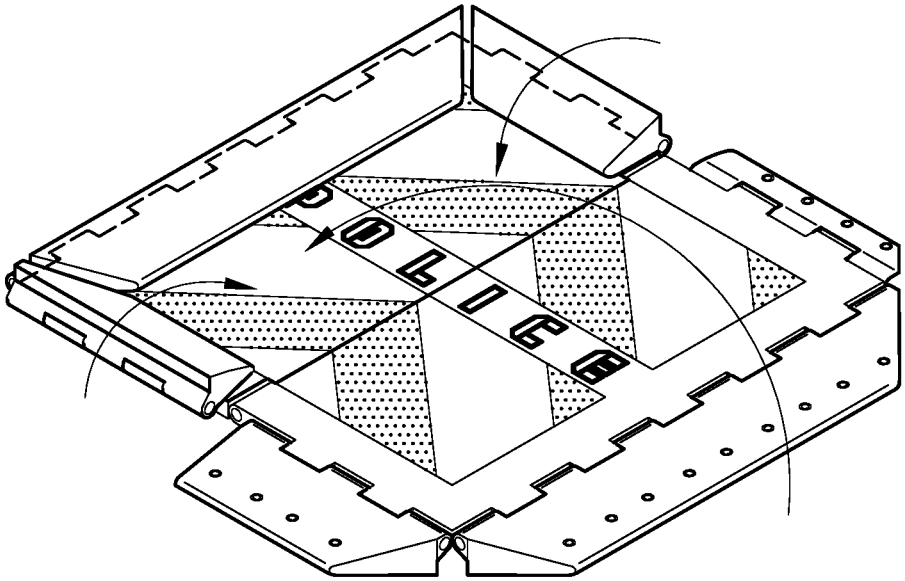
FIG. 7 is a perspective view of an embodiment of the disclosure being folded up for storage.

The plurality of lights 103 further comprises a battery 121, a switch 122, a limit resistor 123 and a plurality of LEDs 124. The plurality of LEDs 124 are distributed along the perimeter of the mat 101 such that the plurality of LEDs 124 are readily visible by traffic. The plurality of LEDs 124 are powered by a battery 121. As shown in FIG. 6, the switch 122 and the limit 123 resistor are placed in series between the plurality of LEDs 124 and the battery 121. The switch 122 is a commercially available normally open single pole single throw switch. The limit resistor 123 is a commercially available resistor that is used to limit current flow through the plurality of LEDs 124.

To use the invention 100, the invention 100 is placed on the resting surface 132 and the plurality of lights 103 are turned on by closing the switch 122. The traffic officer 131 steps on the mat 101 and directs traffic normally.

The plurality of reflective surfaces 102 may be further defined with a pair of split reflective surfaces 166. The pair of reflective surfaces 166 are provided along the second edge 178 as well as the fourth edge 180. Moreover, the pair of split reflective surfaces 166 do not intersect with a middle line 167 provided on the mat 101. The mat 101 may be further defined with a first mat member 168 and a second mat member 169. The first mat member 168 is attached to and pivots with respect to the second mat member 169 via a mat hinge 170 that extends along the middle line 167. The inclusion of the pair of split reflective surfaces 166 in concert with the first mat member 168 and the second mat member 169 facilitates folding the invention 100 in half when not in use, and for storage purposes (see FIG. 7).

The mat 101 is formed from molded plastic. Suitable plastics include, but are not limited to polyvinylchloride, polypropylene, polyethylene, or poly(methyl methacrylic). Poly(methyl methacrylic) is preferred. Fluorescent pigments are commercially available. The fluorescent pigments can be adhered to the surface of the mat 101 as a paint, or the fluorescent pigments can be mixed into the plastic resin that is used to mold the mat 101. Alternatively, a fluorescent tape can be adhered to the plurality of reflective surfaces 102. The components to assemble the plurality of lights 103 are commercially available.

The following definitions were used in this disclosure:

Battery: As used in this disclosure, a battery is a container consisting of one or more cells, in which chemical energy is converted into electricity and used as a source of power.

Fluorescence: As used in this disclosure, fluorescence is the emission of electromagnetic radiation, especially visible light, resulting from the absorption of stimulating radiation and persisting only so long as the stimulating radiation is continued. In a secondary usage, fluorescence will also refer to the electromagnetic radiation that is emitted as described above.

Fluorescent: As used in this disclosure, fluorescent is an adjective that is used to describe an object that exhibits or is capable of exhibiting fluorescence.

Frustum: As used in this disclosure, a frustum is a portion of a solid that lies between two parallel planes that intersect with the solid.

LED: As used in this disclosure, an LED is an acronym for a light emitting diode. A light emitting diode is a 2 lead semiconductor that is also a light source.

Perimeter: As used in this disclosure, a perimeter is one or more curved or straight lines that bounds an enclosed area on a plane.

Pyramid: As used in this disclosure, a pyramid is a three dimensional shape that comprises a square base with four faces that rise from the base to meet at a point above the base. If the point where the four faces meet is positioned such that a line drawn from the point where the four faces meet to the center of the square base is perpendicular to the square base, the pyramid is referred to as a right pyramid. Pyramids formed from rectangular bases instead of square bases are referred to as rectangular pyramids.

Traffic Officers: As used in this disclosure, a traffic officer is a person who has responsibility for directing and controlling traffic flow through a location. Traffic officers include, but are not limited to, police officers, crossing guards, members of road crews, and parking lot employees.

Truncated: As used in this disclosure, a geometric object is truncated when an apex, vertex, or end is cut off by a plane.

Truncated Pyramid: As used in this disclosure, a truncated pyramid is a frustum that remains when the apex of a pyramid is truncated by a plane that is parallel to the base of the pyramid.

With respect to the above description, it is to be realized that the optimum dimensional relationship for the various components of the invention described above and in FIGS. 1 through 7, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A safety apparatus comprising:

a mat, a plurality of reflective surfaces and a plurality of lights;

wherein the safety apparatus is adapted for use by traffic officers;

wherein the safety apparatus attracts attention from a distance;

wherein the safety apparatus is adapted to allow the traffic officer to stand on the safety apparatus in order to receive the attention drawn by the safety apparatus;

wherein the mat is a solid structure that is formed in the shape of a truncated right pyramid;

wherein the plurality of lights further comprises a battery, a switch, a limit resistor and a plurality of LEDs;

wherein the plurality of LEDs are mounted along the perimeter of the mat such that the plurality of LEDs are readily visible by traffic;

wherein the mat is raised such that the mat will raise a traffic officer off a resting surface;

wherein the surface of the mat is further formed with a plurality of non-skid ridges;

wherein the plurality of non-skid ridges is in contact with the resting surface;

wherein each of the plurality of reflective surfaces further comprises a fluorescent material;

wherein the plurality of reflective surfaces are each hingedly attached to the mat;

wherein the plurality of reflective surfaces are each hingedly attached to a first edge, a second edge, a third edge, and a fourth edge of the mat;

wherein the first edge, the second edge, the third edge, and the fourth edge form a perimeter of the mat;

wherein each of the plurality of reflective surfaces attach via a hinge pin to the first edge, the second edge, the third edge, and the fourth edge;

wherein the hinge pin enables each of the plurality of reflective surfaces to rotate relative a respective edge of the perimeter of the mat in order to reduce overalls surface area when not in use, and for storage purposes;

wherein the plurality of reflective surfaces has an angled cross-section, which tapers down from the mat to the resting surface;

wherein the plurality of reflective surfaces each has a non-skid element on a bottom surface, which works in concert with the non-skid ridges of the mat to abate or inhibit movement of the safety apparatus with respect to the resting surface;

wherein each of the plurality of reflective surfaces has a trapezoidal shape when viewed from above;

wherein the safety apparatus forms an octagonal shape;

wherein the first edge, the second edge, the third edge, and the fourth edge of the mat each have a plurality of recessed edges that correspond with notches provided on the plurality of reflective surfaces;

wherein the hinge pin traverses between the notches and the recessed edges to provide pivoting movement between the mat and the plurality of reflective surfaces;

wherein the plurality of LEDs are powered by a battery;

wherein the switch and the limit resistor are placed in series between the plurality of LEDs and the battery.

2. The safety apparatus according to claim 1 wherein the mat is formed from molded plastic.

3. The safety apparatus according to claim 2 wherein the molded plastic is selected from the group consisting of polyvinylchloride, polypropylene, polyethylene, or poly(methyl methacrylic).

* * * * *